United States Patent [19]

Dammann et al.

[11] 4,339,915

[45] Jul. 20, 1982

[54] APPARATUS FOR FALSE TWISTING YARN

[75] Inventors: Peter Dammann; Heinz Schippers; Karl Bauer, all of Remscheid-Lennep, Fed. Rep. of Germany

[73] Assignee: Barmag Barmer Maschinenfabrik, Remscheid, Fed. Rep. of Germany

[21] Appl. No.: 168,734

[22] Filed: Jul. 14, 1980

[30] Foreign Application Priority Data

| | | | |
|---|---|---|---|
| Jul. 14, 1979 | [DE] | Fed. Rep. of Germany | 2928522 |
| Dec. 24, 1979 | [DE] | Fed. Rep. of Germany | 2952305 |
| Mar. 4, 1980 | [DE] | Fed. Rep. of Germany | 3008233 |
| Apr. 11, 1980 | [DE] | Fed. Rep. of Germany | 3013948 |

[51] Int. Cl.[3] ..... D02G 1/08; D01H 7/92

[52] U.S. Cl. ..... 57/339; 57/340; 57/348

[58] Field of Search ..... 57/336–340, 57/348

[56] References Cited

U.S. PATENT DOCUMENTS

| | | | |
|---|---|---|---|
| 2,863,280 | 12/1958 | Ubbeiohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa et al. | 57/337 |
| 4,145,871 | 3/1979 | Iwata et al. | 57/340 |
| 4,149,366 | 4/1979 | Bass et al. | 57/339 X |

FOREIGN PATENT DOCUMENTS

| | | |
|---|---|---|
| 2001120 | 7/1971 | Fed. Rep. of Germany . |
| 2121917 | 8/1971 | France . |

*Primary Examiner*—John Petrakes

*Attorney, Agent, or Firm*—Bell, Seltzer, Park & Gibson

[57] ABSTRACT

An apparatus for false twisting a yarn is provided which comprises, in one embodiment, a thin pliable disc mounted for rotation with a cooperating disc or roller to define a twisting zone between opposing friction surfaces thereof. A pressure applying member is mounted adjacent the back face of the pliable disc for biasing the disc toward the other member locally at the twisting zone so as to firmly engage the yarn passing through the twisting zone and while the friction surfaces remain in substantially non-contacting relationship with respect to each other. The pressure applying member utilizes an air cushion between the member and back face of the disc to minimize friction. Where two discs are employed, they may be mounted for rotation in a common direction, and such that the yarn may be guided through the twisting zone without passing between the axes of rotation of the discs.

28 Claims, 28 Drawing Figures

APPARATUS FOR FALSE TWISTING YARN

The present invention relates to an apparatus for twisting or texturing textile filament yarns. The invention particularly relates to the action of revolving friction work surfaces moving in opposite directions or crossing each other, which friction surfaces contact the circumference of one or several textile filaments or yarns running therebetween, to both twist and advance the yarns by direct frictional contact. More particularly, the present invention relates to the design and construction of a pressure apparatus for devices adapted to texturize textile filament yarns according to the principle of imparting twist by direct frictional contact between two friction surfaces.

False twist apparatus are known, which consist of two circular discs rotating in opposite directions, and which are inclined toward each other at an angle so as to contact each other at one location adjacent their edges. In an apparatus of this type, (note for example German Publication AS 11 92 779, U.S. Pat. Nos. 3,156,084 and 4,145,871), the rotary shafts of the discs are offset and the discs are mechanically pressed against each other by spring pressure. In another apparatus of this kind (note German Publication AS 16 60 351), it is suggested that the work surfaces of the discs be magnetically pressed against each other by having, for example, the discs in the form of magnets with opposite polarity and consisting at least partially of a permanent magnet material.

In known disc assemblies having the discs arranged adjacent each other with a narrow gap and at a small angle, and with the discs being pressed against the filament yarn in the yarn processing zone, even a very slight unbalanced or circular intolerance of the discs is highly disadvantageous, since at the high speed and the mass moment of inertia of the discs, such unbalance leads to deviations of the twist level in the yarn and thus to faulty texturizing, which is visible in the resulting woven fabric. Similar disadvantageous consequences also result from different temperatures of the discs during operation, from heat expansion of the discs, which changes the gap width, or from swelling of the surfaces of the disc materials when the friction of the discs is reduced by a liquid lubricant.

The objects of the invention are to obtain a better and more uniform textured yarn, to improve the pressure contact of the work surfaces effecting direct frictional contact on the yarn, and to provide a more effective twisting zone in an apparatus of the described type.

These and other objects and advantages are achieved in the embodiments illustrated herein by the provision of a pair of twist imparting members, with at least one of the members comprising a thin and pliable circular disc. Pressure forces are applied to the back side of the disc in alignment with the twisting zone to bias the disc toward the other member, and such that a yarn may be moved through the twisting zone while having twist imparted thereto by frictional contact with the two members, and while the yarn engaging friction surfaces of the members remain in substantially non-contacting relationship with respect to each other.

The pressure forces are transferred directly to the disc with little friction, by means of a fluid pressure applying member, and without use of a rotating back-up roller or the like which would need to be accelerated. Yet another advantage is that wear between pressure applying member and the disc is minimized by utilizing a fluid cushion on the back face of the disc. In this embodiment, pressure is applied by the force of an outflowing pressure fluid, assisted if desired by static pressure forces, and the pressure applying member does not contact the work surface at all, so that there is no wear. Advantages also result in that the pressure zone can be adapted to the structural conditions of the apparatus, by means of selective geometrical profiling of the pressure member, and the magnitude of force can be readily adjusted to the desired parameters of the texturing process, such as denier, twist level, disc and yarn speeds, by controlling the pressure and amount of the fluid. This is particularly the case due to the elastic deformability of the work surface, and since a defined pressure or twisting zone is created, which is easily conformable to the yarn nip line.

The pressure applying member according to the invention is preferably designed and constructed as a cylinder-piston assembly, with the piston being actuated by a pneumatic fluid. In one embodiment, the piston has an insert body made of a material with a low friction coefficient. In an advantageous further embodiment of the apparatus, this insert body, which geometrically defines the twisting zone, may be porous and be lubricated through a longitudinal bore in the piston by a suitable gaseous or liquid pressure fluid to further reduce friction and wear.

In another embodiment of the pressure applying member, the insert body is omitted, and pressurized air acts directly on the back face of the flexible disc, in order to press the disc locally and elastically against the filament yarn. The pressurized air form a cushion, which is built up between the lower free end of the piston and the work surface, and effects the required pressure of contact between the yarn and the two opposing friction surfaces.

The pneumatic lubrication between the pressure surface of the piston and the work surface is particularly advantageous, in that little force is required to apply the pressure, and wear is substantially avoided by the non-contact transfer of the biasing force. It should be also noted that the pressure applying member is essentially insensitive to unevenness of the running surface of the disc, and readily absorbs shocks. Thus the surface properties of the back face of the disc are relatively unimportant.

As a further aspect of the present invention, the second twist imparting member may be another flexible disc, the rigid disc, or a roller having a rigid surface. Such a roller may be less expensive and simpler in design than another rigid disc. The roller may be tiltable to adjust it to the crossover angle between the thread line and that plane which is normal to the axis of the roller. Such a rigid roller may have a cylindrical peripheral surface, or it may be conical. Still further, the surface of the pressure applying member may be convex, and the roller may have a hyperbolic peripheral surface to conform to that of the pressure applying member.

In a false twist texturizing machine with a plurality of thread lines and a corresponding plurality of false twisters, all rollers of the machine may be positioned on one common shaft extending horizontally across the machine, and the axis of the flexible discs may be mounted vertically to such shaft and parallel to each other in such a way that the friction surfaces of the flexible discs are disposed tangentially with the surfaces of respective rollers. Pressure applying members are mounted opposite to said rollers for pressing the flexible discs against the surfaces of said rollers, thereby resulting in a very simple and inexpensive design of the false twist machine.

It has been found that the present texturing apparatus can also be used in a particularly simple and advantageous manner to produce various types of effect (fancy) threads by, for example, varying the surface speed of the work surfaces according to a preset program. It is, however, preferred that the fluid pressure be varied periodically or according to a program, which allows the piston of the pressure applying member to similarly press against the back face of the disc. It may be preferred to also apply these variations irregularly according to a random distribution. This allows the slip between the yarn and the friction surfaces to be advantageously effected, and permits control of the yarn thickness or the distribution of crimp degree in the yarn at the same operating speed, whereby certain textile technological effect can be brought about in a directed manner.

It is also possible to purposely produce twisted areas in the yarn by periodically increasing the speed of rotation, while possibly simultaneously increasing the contact pressure, to thus intentionally obtain such textile technological effects. Finally, the work surfaces cooperating with the yarn may be designed with respect to their friction coefficient in such a manner that they provide an increased slip when the contact pressure is reduced periodically or in accordance with a predetermined program, and thus roughly act on the yarn surface in a manner which is intended to break filaments and impart a certain fiber yarn characteristic to textured multifilament yarns. To generate irregularities producing such effects, the yarn guides preceding and following the yarn treatment zone may be also adjusted in accordance with a preset program. It is also contemplated that the crossing angle and thus the twisting and advancing forces acting on the yarn may be varied, as well as varying the friction coefficients of the work surfaces.

In accordance with still another aspect of the invention, two friction discs, which may be either flexible or rigid, are mounted for rotation in the same direction about parallel, spaced apart axes. The yarn may in such case be moved along a path of travel and through the twisting zone in a direction parallel to and laterally spaced from a line extending perpendicularly between the axes of rotation. This construction permits a number of false twisting units to be mounted on two parallel shafts extending horizontally across a multi-station machine, and without the need for the yarns to be threaded between the shafts.

Some of the objects and advantages of the invention having been stated, others will appear as the description proceeds, when taken in connection with the accompanying drawings, in which FIG. 1 is a top plan view of a yarn false twisting apparatus which embodies the present invention;

FIG. 2 is a sectional side elevation view of the apparatus shown in FIG. 1;

FIGS. *2a, 2b, 2c, 2d* and *2e* are fragmentary sectional views of different embodiments of the pressure applying member used with the present invention;

Figure 1:
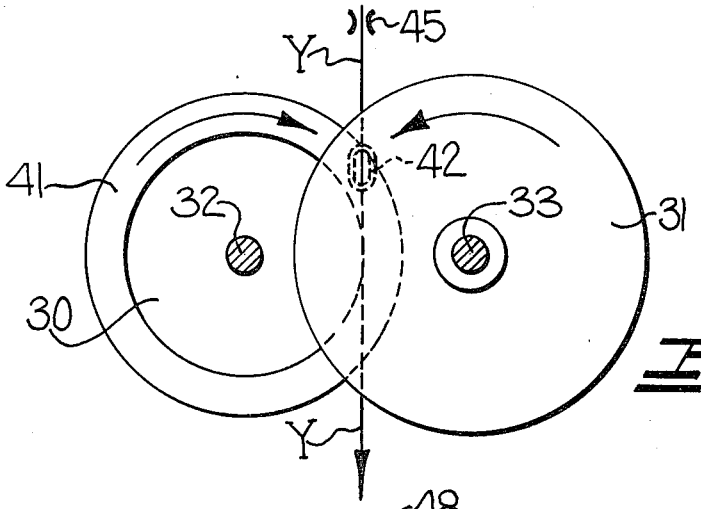

Referring more particularly to the drawings, FIG. 1 illustrates a yarn false twisting apparatus embodying the present invention and which comprises a pair of twist imparting members 30, 31 which are mounted for rotation about parallel, spaced apart shafts 32, 33 respectively. The member 31 is in the form of a relatively thin circular disc having opposite flat faces 35, 36 with the face 35 defining a yarn engaging friction surface, and is fixed for rotation with the shaft 33 by the hub assembly 38. The disc 31 is formed of a material more particularly described below, and is readily pliable in a direction perpendicular to its faces. The member 30 is in the form of a rigid, non-yielding disc which is cup shaped in cross section and includes a raised circular band 40 at the radial periphery which defines a cooperating yarn friction surface 41. The discs 30, 31 are mounted so that the respective yarn engaging friction surfaces 35, 41 are disposed in substantially non-contacting relationship and define a twisting zone 42 therebetween.

The apparatus further includes a pressure applying member 44 disposed adjacent the back face 36 of the disc 31 for biasing the disc toward the rigid disc 30 at the twisting zone 42 and during rotational movement of the two discs. Thus a yarn Y may be continuously moved from guide 45 through the twisting zone 42 while having twist imparted thereto by frictional contact with the friction surfaces resulting from the force exerted by the pressure applying member 44, and while the friction surfaces remain in substantially non-contacting relationship with respect to each other.

Figure 2:
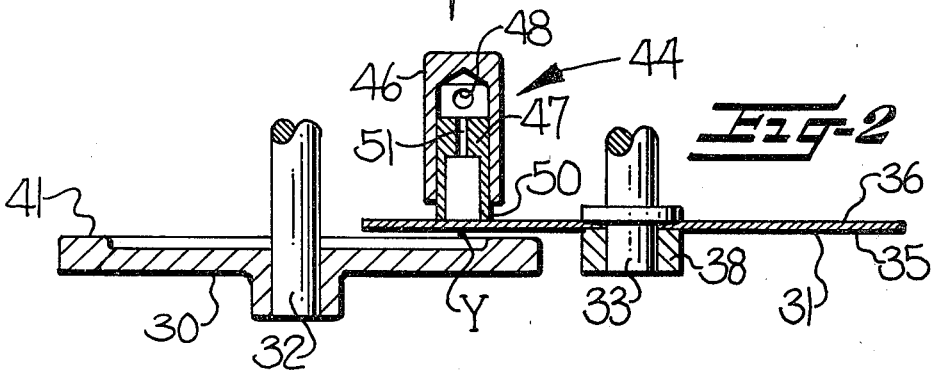

The pressure applying member 44 as illustrated in FIG. 2 comprises a cylinder 46 and a piston 47 slidably disposed in the cylinder for axial movement toward and away from the face 36 of the flexible disc. Pressurized air is delivered into the interior of the cylinder through the line 48 which serves to bias the piston downwardly. Also, the piston includes an open cylindrical skirt 50 at its lower free end, and an axial bore 51 through the piston head for admitting the air into the area of the skirt. By this arrangement, pneumatic lubrication is provided between the lower edge of the skirt and the face of the disc, as further described below.

FIGS. *2a* and *2b* illustrate an alternative pressure applying member 54 comprising a similar cylinder 55 and piston 56, but wherein the piston includes a rod 57 mounting an insert 58 at the lower end thereof. The pressure force acting on the piston 56 is transmitted through an intermediate layer of resilient and vibration absorbing material 59 to piston rod 57, so that vibrations resulting from unevennesses of the face of the disc or the filament yarn itself are absorbed. Piston 56 is connected through piston rod 57 to a plunger 60, which is secured to insert 58, as by glue.

Figure 2A:
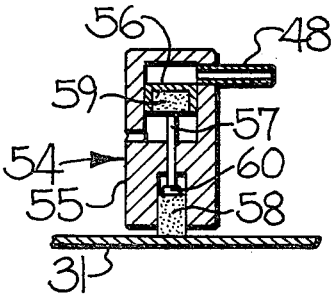
Figure 2B:
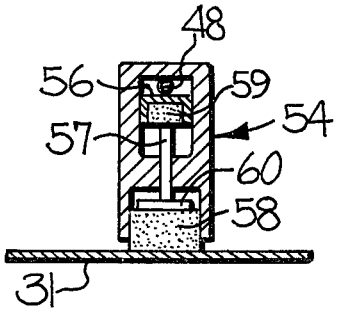

In the pressure applying member 54 as shown in FIGS. 2*a* and 2*b*, the yarn twisting zone can be geometrically defined by correspondingly profiling the cross section of insert 58 and, in accordance with the optimal conditions, can be selected in dependence on the width and crossing angle of the rotating discs. Thus, for example, a long and narrow or oval twisting zone is suitable to keep the wear between insert 58 and disc 31 low, and to transfer at the same time a defined pressure force to the yarn. A sufficiently long guideway of piston rod 57 in the cylinder avoids having the insert body become tilted from wear.

The insert 58 may consist of graphite to keep friction low. A sintered graphite insert is preferred, which is interspersed with metallic particles of bronze, copper or the like to improve the dissipation of heat. On the other hand, the insert may consist of an open porous material which is impregnated with a suitable lubricant.

Figure 2C:
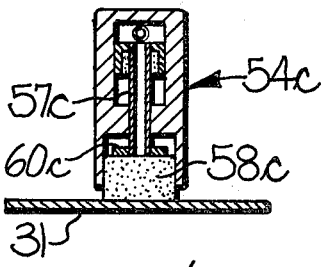

Another embodiment of the pressure applying member is shown at 54*c* in FIG. 2*c*, and distinguishes itself by supplying air or liquid lubricant through an axial longitudinal bore in piston rod 57*c* and plunger 60*c* to the open porous sintered insert 58*c*. For example, this lubricant may be a portion of the pressure fluid which acts on the piston of the pressure applying device. In addition, a finely distributed liquid lubricant may be added to the stream of air.

Figure 2D:
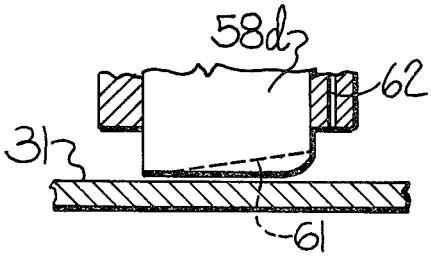
Figure 2E:
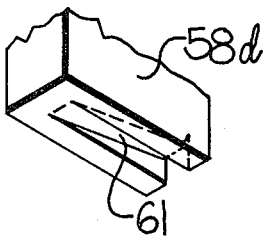

FIGS. 2*d* and 2*e* show a pressure applying member which comprises a solid metalic insert 58*d* attached to a plunger (not shown) as described above. This insert 58*d* has parallel longitudinal edges for its guidance in the cylinder and an inclined or a wedge-shaped face 61 immediately adjacent the disc. The insert 58*d* is made of a material highly resistant to wear. A lubricant, preferably water, a harmless finishing fluid for yarn or a suitable oil emulsion, may be applied in doses through nozzle 62 located in front of the insert in the direction of the running disc or, if necessary, provided in the insert itself, or through a wick, to the adjacent face of the disc. The lubricating film produced during operation of the apparatus between insert 58*d* and disc makes it possible to reduce the friction and the resulting heating of the insert, when the pressure forces are transferred to the disc.

One advantage in employing a rigid disc in association with the flexible or pliable disc as illustrated in FIGS. 1 and 2 resides in the fact that harder and more resistant materials can be used for the work surfaces. Suitable materials for this purpose are plastics, steel and other metallic as well as ceramic materials, whose surfaces may be treated in known manner, such as plasma coating or the like, to improve the frictional conditions against the filament yarn and to increase the life of the friction surfaces. Another advantage resides in that for each twisting or texturing apparatus, only one pressure applying device is needed, since one of the work surfaces is rigid.

Figure 3:
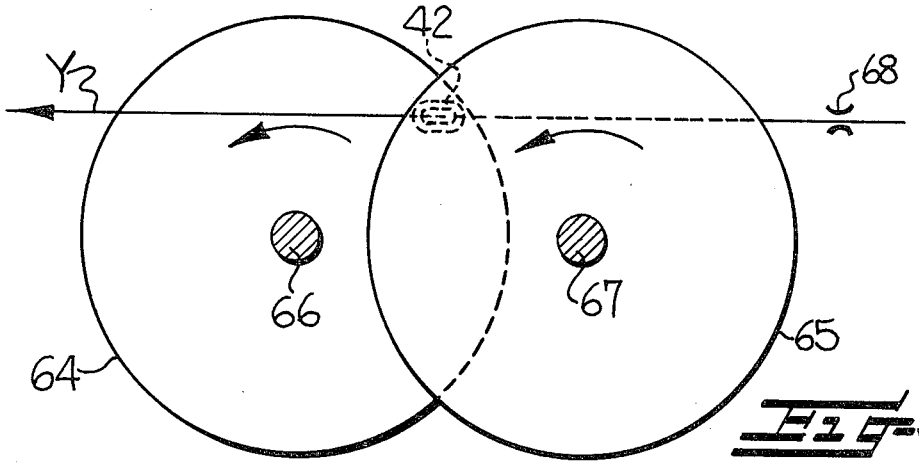
FIG. 3 is a top plan view of a second embodiment of the invention.

As best seen in FIG. 1, the shafts 32, 33 may be rotated in opposite directions, with the yarn being fed from guide 45 through the twisting zone 42 and between the two shafts. However, the apparatus according to FIGS. 1 to 6 can be operated with a different thread line, with the discs being rotated in a common rotary direction. For example, FIG. 3 shows two discs 64, 65 of like diameter mounted for rotation on the shafts 66, 67 respectively. The yarn path extends from guide 68 in a direction parallel to and laterally spaced from a line extending perpendicularly between the axes of rotation of the shafts 66, 67. In the embodiment of FIGS. 1 and 2, it will be noted that the yarn must be initially threaded between the shafts 32, 33. In FIG. 3 however, there is no need to thread the yarn between the shafts 66, 67, which is an important advantage and permits a number of false twisting units to be mounted on two parallel vertically spaced shafts which extend horizontally along the length of a multi-station machine.

It should also be noted that the use of discs of different diameters, as shown in the embodiment of FIG. 1, leads to an asymmetrical overlapping of the friction surfaces and has an advantage in that the yarn entry does not coincide with the cusp area of the discs.

Figure 4:
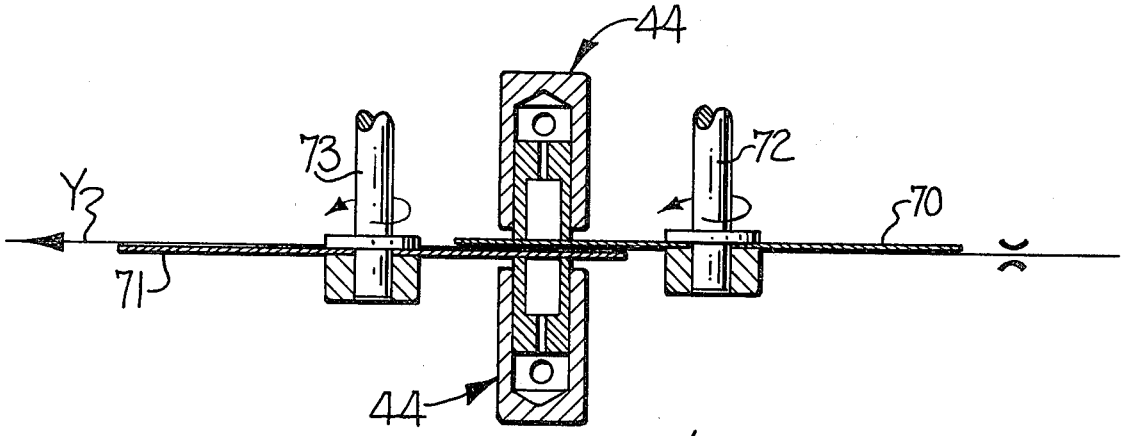
FIG. 4 is a sectional side elevation view of the apparatus of FIG. 3.

FIG. 4 shows a texturing apparatus which comprises two flexible, thin discs 70, 71 which are mounted on parallel shafts 72, 73 at a short axial spacing. The discs are driven in the same direction, as indicated by the arrows. The discs may be fabricated from steel, an aluminum alloy, a suitable plastic or the like and are biased in the area of the twisting zone by means of a pair of opposed pneumatically operated pressure applying members 44 as described above, and which act on the back face of each disc. The thread line is identical with that shown in FIG. 3.

Figure 5:
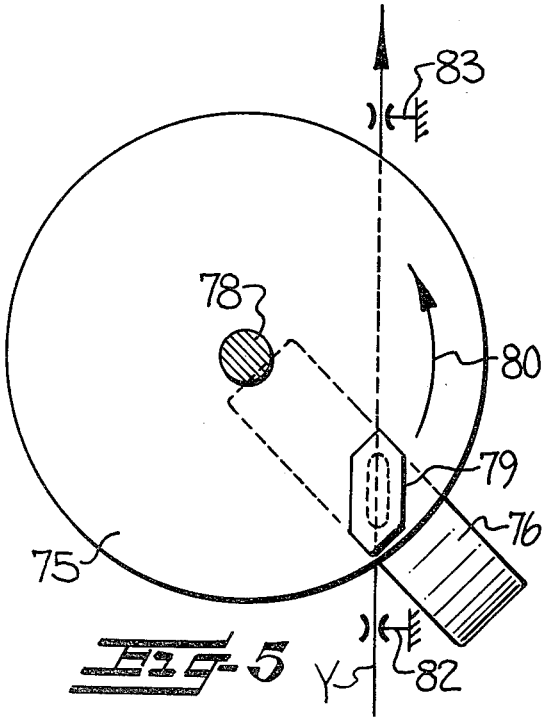
FIG. 5 is a top plan view of still another embodiment of the present invention.
Figure 6:
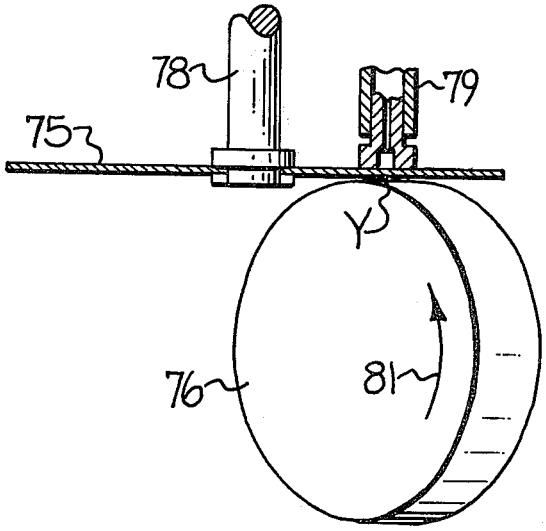
FIG. 6 is a sectional side elevation view of the apparatus of FIG. 5.
Figure 7:
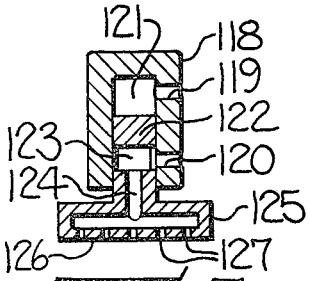
FIG. 7 is a sectional side elevation view of another embodiment of a pressure applying member in accordance with the present invention.

FIGS. 5 and 6 show in top and side view a texturing apparatus having a rotatably driven flexible disc 75 disposed tangentially with the peripheral surface of a rigid cylinder or roller 76 and defining a twisting zone therebetween. The flexible disc 75 is driven by a shaft 78 and is locally pressed against the yarn and against the roller in the twisting zone by the action of the pressure applying member 79. The yarn Y is conveyed in the direction of the arrow as shown in FIG. 5, and simultaneously is false twisted. In doing so, flexible disc 75 is driven in the rotary direction indicated by arrow 80 and rigid roller 76 is rotated in the direction indicated by the arrow 81. The yarn is supplied or guided away, respectively, by yarn guides 82 and 83 in such a path that the circumferential speeds of the disc 75 and the surface of roller 76 are essentially the same in the twisting zone.

FIGS. 16–22 illustrate several other embodiments of pressure applying members adapted for use with the present invention. In each case, the device comprises a cylinder and piston. The pressurized air is supplied to the cylinder through a supply line, which acts statically on the surface of the piston, and also flows through an axial bore in the piston and into the widened space of the skirt, which forms an open air cushion chamber. In its cross section, the skirt may be shaped according to the desired geometrical form of the twisting zone.

The piston moves outwardly toward the disc when pressure is applied to it, and until it touches the back face of the disc. Due to the sealing effect of the skirt of the piston, a further outflow of the air is essentially precluded. Assuming that the gap between the piston surface and the back face of the disc is sealed, the pressures in front of the piston surface and in the air cushion chamber balance, with a balance of forces being established. However, since leakage occurs between the skirt of the piston and the rotating disc, air always flows through the axial bore, and the pressure in the air cushion chamber is thus less than that on the surface of the piston. Thus, the skirt of the piston is pressed somewhat more and the sealing effect is increased, which again leads to reduced leakage. The position of piston, gap width, consumption of air and the action of the force by the piston on the disc thus interdepend, with a state of equilibrium being established automatically. The fluid pressure built up in the air cushion chamber can only be relieved through a gap, which forms between skirt of piston and the back face of the disc, with the gap interrupting the frictional contact between the two surfaces and the pressure force is thus transmitted through an interposing air cushion. Thus, the preferred embodiment of the pressure applying member according to the invention is based on this mechanism of pneumatic lubrication of the piston surface, with simultaneous exertion of an adjustable pressure force on a flexible work surface in the twisting zone.

Figure 20:
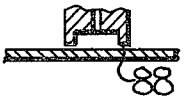
Figure 21:
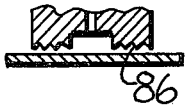
Figure 22:
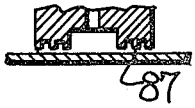

The bottom edge of the skirt of the piston is suitably shaped, as shown in FIGS. 19 to 22, to take into account the conditions of the texturing apparatus, the surface properties of the disc, the desired surface pressure in the twisting zone, or the consumption of the air. Thus, for example, the wide edge between the air cushion chamber and the outer atmosphere as indicated at 85 in FIG. 19 or a labyrinth-like structure in the piston edge surface as illustrated at 86, 87 of FIGS. 21 and 22 serve to reduce the consumption of compressed air, while a narrow rim surface 88, as shown in FIG. 20, effects a sharper definition of the twisting zone.

Figure 18:
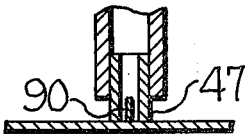
Figure 19:
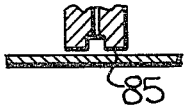

A piston having an air cushion chamber in its surface is preferred so as to completely avoid friction between the piston and the back face of the disc according to the present invention. However, as shown in FIG. 18, the piston 47 can be also constructed in such a manner that it has several axial bores or slots 90 in the axial direction, through which a stream of the pressure medium can continuously flow out, which "lubricates" the pressure surface of the piston. Such slots, for example, are suitable for oblong or elongated oval piston surfaces.

Figure 16:
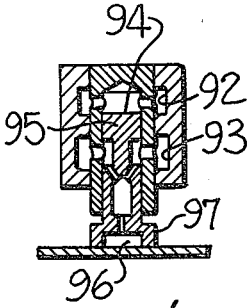
FIGS. 16–22 are sectional side elevation views of pressure applying devices, or fragmentary portions thereof, in accordance with the present invention.
Figure 17:
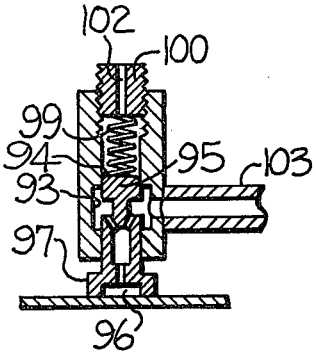

In FIGS. 16 and 17, the above described pressure applying member is modified in such a manner that the cylinder-piston assembly is connected to two different sources of pressure through annular ducts 92 and 93, with the duct 92 communicating with a chamber above the upper face 94 of the piston 95, and the duct 93 communicating with the air cushion chamber 96 formed by the skirt 97. This presents the advantage that the pressure force on the face 94 of the piston is independent of the quantitative supply to the air cushion chamber 96, since it can be separately adjusted through a self-contained compressed air supply. This permits the pneumatic lubrication film (air cushion) between piston surface and the back face of the disc to be separately adjusted.

As shown in FIG. 17, the cylinder-piston assembly is additionally modified by the action of a force produced by the pressure fluid on the face 94 of piston 95, together with a pressure spring 99, which is biased against the face 94. Other suitable biasing means could be employed for this purpose, such as a permanent magnet, an electromagnet, a weight or the like. The spring 99 may if desired be mechanically preloaded by an adjustable screw cap 100, which also includes a bore 102 for admitting air to the chamber above the piston face 94. Compressed air for the air cushion 96 is supplied from a line 103 in the manner described above with reference to FIG. 16.

FIGS. 7–15 schematically illustrate further embodiments of the cylinder-piston structure for the pneumatically operating pressure member. As here illustrated the pressure applying member consists of a cylinder 118, which can be connected through two fluid supply ducts 119 and 120 and to two sources of pressure (not shown). It should be noted that the fluid pressures in both lines can be constantly adjusted through usual valves or throttling devices to a predetermined value, at which the pressure applying member provides the best texturing results for a multifilament yarn processed and for certain machine settings. These values can be easily determined by simple tests.

Figure 8:
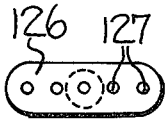
FIGS. 8–10 are bottom plan views illustrating various configuration of the pressure applying member of FIG. 7.
Figure 9:
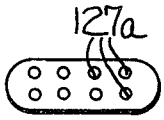
Figure 10:
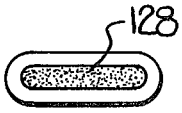

Fluid supply duct 119 terminates in the cylinder 118 in a pressure space 121 above the piston 122 and pushes the piston out of cylinder 118 until it has reached an extended position defined by a stop (not shown) or until a counterforce has restored the equilibrium of forces. The second fluid supply duct 120 terminates in pressure space 123 below the piston 122 and is connected through an axial bore 124 to distributor duct 125 following same and to piston surface 126. The pressurized air emerging from the surface of piston, forms a pressure cushion between piston surface 126 and the back face of the flexible disc. Through this cushion, the force supplied by piston is transmitted to the yarn twisting zone, and thus friction and wear are eliminated. The longitudinal section in FIG. 7 and the bottom view of piston surface in FIG. 8 show that the pressure fluid serving for the air lubrication is distributed from a distributor duct extending along the yarn nip line to several holes 127 provided in the piston surface 126 and emerging therefrom. According to FIG. 9, the pressure fluid is distributed to two parallel arranged lines of holes **127*a*, whereas in FIG. 10 a zone 128** of the piston surface extends along the yarn nip line, and consists of a porous material which is inserted in the piston surface, and which, if needed, may be arcuately curved along one dimension.

Figure 11:
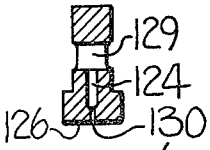
FIG. 11 is a sectional side elevation view of a piston for a pressure applying member.
Figure 12:
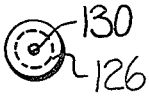
FIGS. 12–15 are bottom plan views illustrating various configurations of the piston of FIG. 9.
Figure 13:
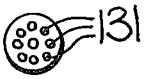
Figure 14:
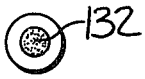
Figure 15:
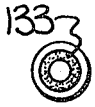

Pressure applying members using a piston 129 as shown in FIG. 11 have proven to be successful. Axial bore 124, through which the pressure fluid needed for the air lubrication emerges, terminates in a central throttle bore 130 in the piston surface 126 of piston 129, or in an annular duct, which may be followed, for example, by holes 131 distributed around the circumference, as shown in FIG. 13, a porous circular surface 132, as shown in FIG. 14, or a porous annular surface 133 in the piston surface, as shown in FIG. 15. In addition to the pressure applying member providing an air cushion on the piston surface, the construction of the piston surface 126 as described and shown in FIGS. 7–15 makes it possible to also suppress high frequency oscillations occurring at difficult operational settings and high speeds of the work surfaces, which can adversely affect the smooth run of yarn and generate disturbing noise.

The pressure applying members as shown in FIGS. 1, 2, 4 should be removed somwhat from the outer circumferential edge of the flexible disc. However, high centrifugal forces are acting on the spot of the flexible disc against which the pressure applying member acts. These high centrifugal forces insure that the flexible disc is bent only on that very spot towards the yarn and the rigid surface, and where the pressure applying member acts. In all its other portions, the flexible disc remains flat.

The flexible discs according to this invention preferably consist of a thin-walled material capable of enduring high tension, but which are pliable in a direction perpendicular to its opposing faces. This leads to the fact that the biasing means tends to upset the material, and thereby push the friction surface in the direction of the rigid disc and to thereby form a narrow gap, in which the yarn is jammed.

It has been found particularly advantageous for this invention to use a compound material for the friction surfaces, which consists of an elastomeric component, preferably a chemical material having a base of an acrylonitrile/butadiene interpolymer or a polyurethane rubber, and which has a core yarn inserted in a plane parallel to the friction surface of the disc to absorb the centrifugal forces which are operative on the disc. The elastomeric component of the friction surface material insures that the running yarn is twisted with little slip and also, it provides a favorable elastic deformability of the disc in the twisting zone, since the core yarn component does not render any noticeable resistance to a deformation by the transverse force applied locally on the back face of the disc.

The above specified material combination also offers the advantage that the work surfaces outside of the twisting zone do not remain pressed against each other, but are separated by the air carried along between the friction surfaces and thus remain out of contact. This means that no detectable wear occurs in the area of the overlapping work surfaces, even when no yarn is present.

The core yarn inserted to absorb the centifugal forces operative on the disc may be in the form of a flat web of high-tensile fibers, preferably in the form of an unoriented fiber web. Also, the yarn may take the form of a woven or knit fabric, or a spread of threads or the like, which is impregnated with a solution of the elastomeric component and has covering layers of this material. The core yarn may consist in particular of organic fibers, such as natural, synthetic or carbon fibers, or of high-tensile polyamide or polyethyleneterephthalz fibers. It is also possible to use inorganic fibers, such as fiber glass or metallic fibers, in particular steel fibers (steel cord), for the core yarn component.

The total thickness of the discs of the present invention typically is between 0.6 and 2.5, preferably between 0.8 and 1.4 mm, with the outer disc diameters measuring approximately 80 mm. The tests which have been conducted resulted, at yarn speeds above 600 m/min., in the yarn receiving a very even twist, and led to a very regular crimp of the yarn after it had been heat set. After a long period of operation of the assemblies, no wear could be detected on the friction surfaces. Even when an end was down, and the biasing pressure mistakingly remained operative, no wear could be detected.

Depending on the thickness of the disc and the number of layers, several core yarn layers may be arranged one above the other and angularly displaced with respect to each other so that the respective warp and filling threads are angularly displaced to each other and so that the tensile strength is essentially constant for all areas of the disc.

Figure 23:
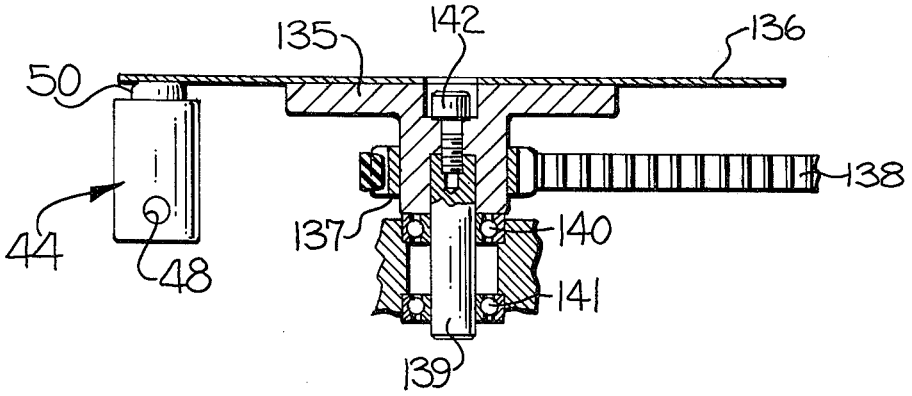
FIG. 23 is a sectional side elevation view of a particular mounting structure for the flexible disc and in accordance with the present invention.

FIG. 23 shows another embodiment for attaching the flexible disc to its supporting shaft, and which includes an axially symmetrical carrier body 135 having a flat upper surface on which flexible disc 136 is glued. In the area of the yarn twisting zone, the pressure applying member 44 acts on the radially projecting edge of the flexible disc. As described above, the flexible disc 136 consists of a compound material of an elastomeric component and a core yarn component. To increase the rigidity of this disc, the core yarn may consist of very thin metallic fibers. Carrier body 135 supporting flexible disc mounts a toothed pulley 137 over which toothed belt 138 is conducted to drive the disc. Carrier body 135 is secured to rotary shaft 139, which is rotatably mounted in bearings 140, 141, by screw 142.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a pair of twist imparting members, at least one of said members comprising a relatively thin circular disc having opposite flat faces, with one of said faces defining a yarn engaging friction surface, and with said disc being readily flexible in a direction perpendicular to said faces, the other of said members having a generally flat yarn engaging friction surface, means mounting said members for rotational movement wherein portions of the respective yarn engaging friction surfaces are disposed in opposing, substantially non-contacting relationship and define a twisting zone therebetween, means for rotating each of said members such that their respective yarn engaging friction surfaces run in different directions through said twisting zone, and means operatively mounted adjacent said circular disc for biasing said disc toward the other member at said twisting zone and during the rotation thereof, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

2. The yarn false twisting apparatus as defined in claim 1 wherein said members are mounted for rotation about parallel, spaced apart axes.

3. The yarn false twisting apparatus as defined in claim 2 wherein said other member comprises a disc of a diameter substantially equal to that of said flexible disc, and wherein said rotating means acts to rotate said discs in a common rotational direction, and the yarn is adapted to move through said twisting zone in a direction parallel to and laterally spaced from a line extending perpendicularly between the axes of rotation and without passing between said axes of rotation.

4. The yarn false twisting apparatus as defined in claim 2 wherein said other member comprises a rigid, substantially non-yielding disc.

5. The yarn false twisting apparatus as defined in claim 4 wherein said rigid disc is cup shaped in cross section and includes a raised circular band at the radial periphery, and wherein the surface of said band comprises said friction surface thereof.

6. The yarn false twisting apparatus as defined in claim 5 wherein said friction surface of said rigid disc includes a coating of a material having a high friction coefficient.

7. The yarn false twisting apparatus as defined in claim 6 wherein said flexible disc comprises a textile reinforced rubber-like material having a thickness between about 0.6 and 2.5 mm.

8. The yarn false twisting apparatus as defined in claim 1 wherein said biasing means comprises a cylinder mounted adjacent the face of said flexible disc opposite its yarn engaging friction surface and aligned with said twisting zone, a piston slidably mounted in said cylinder for axial movement toward and away from the adjacent face of said flexible disc, an insert of a material having a low friction coefficient fixed to said piston and adapted to contact the adjacent face of said flexible disc, and pneumatic means for urging said piston and thus said insert toward the adjacent face of said flexible disc.

9. The yarn false twisting apparatus as defined in claim 8 wherein said insert comprises graphite.

10. The yarn false twisting apparatus as defined in claim 8 wherein said insert comprises an open porous material, and duct means extending axially through said piston for conveying air through said insert so as to act as a cushion between said body and the adjacent face of said flexible disc.

11. The yarn false twisting apparatus as defined in claim 8 wherein said biasing means further comprises passageway means for conveying a fluid directly to the surface of the adjacent face of said flexible disc and forwardly of said insert, and so that the fluid acts as a lubricant between said insert and such face.

12. The yarn false twisting apparatus as defined in claim 1 wherein said biasing means includes a cylinder mounted adjacent the face of said flexible disc opposite its yarn engaging friction surface and aligned with said twisting zone, a piston slideably mounted in said cylinder and having a free end positioned to directly overlie the adjacent face of said flexible disc, and means for conveying pressurized air between said free end of said piston and the adjacent face, and so as to form an air cushion therebetween.

13. The yarn false twisting apparatus as defined in claim 12 wherein said free end of said piston is in the form of an open skirt, and said air conveying means includes first air duct means for biasing said piston toward said adjacent face and second air duct means for directing pressurized air into the interior of said skirt.

14. The yarn false twisting apparatus as defined in claim 1 wherein said other member comprises a roller having a rigid, non-yielding peripheral surface forming the friction surface thereof, with said roller being mounted for rotation so that said yarn engaging friction surface of said disc is disposed tangentially with respect to said peripheral surface of said roller.

15. The yarn false twisting apparatus as defined in claim 14 wherein said peripheral surface of said roller is cylindrical.

16. A yarn false twisting apparatus comprising a pair of relatively thin circular discs, with each of said discs having opposite flat faces with one of said faces defining a yarn engaging friction surface, and with said discs each being readily flexible in a direction perpendicular to said faces, means mounting said discs for rotation about parallel, spaced apart axes such that portions of the respective yarn engaging friction surfaces are disposed in opposing, substantially non-contacting relationship and define a twisting zone therebetween, means for rotating each of said discs such that their respective yarn engaging friction surfaces run in different directions through said twisting zone, and means operatively mounted adjacent the face of each of said circular discs opposite the yarn engaging friction surface for biasing said discs toward each other at said twisting zone and during the rotation thereof, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

17. The yarn false twisting apparatus as defined in claim 16 wherein said rotating means acts to rotate said discs in opposite rotational directions, and wherein the yarn is adapted to pass between the axes of rotation.

18. The yarn false twisting apparatus as defined in claim 16 wherein said rotating means acts to rotate said discs in a common rotational direction, and wherein the yarn is adapted to move through said twisting zone in a direction parallel to and laterally spaced from a line extending perpendicularly between the axes of rotation and without passing between said axes of rotation.

19. A yarn false twisting apparatus comprising a pair of twist imparting discs, with each disc having a yarn engaging friction surface on one face thereof, means mounting said discs for rotation about parallel, spaced apart axes and such that portions of the respective yarn engaging friction surfaces are disposed in opposing, substantially non-contacting relationship and define a twisting zone therebetween, means for rotating each of said discs in a common rotational direction and such that their respective yarn engaging friction surfaces run in different directions through said twisting zone, and yarn guide means for guiding a moving yarn through said twisting zone in a direction parallel to and laterally spaced from a line extending perpendicularly between said axes of rotation and so as to have twist imparted thereto by frictional contact between the yarn and the respective opposed friction surfaces.

20. The yarn false twisting apparatus as defined in claim 19 wherein said discs have substantially equal diameters.

21. A yarn false twisting apparatus comprising a pair of twist imparting members, with each member including a yarn engaging friction surface, and at least one of said members comprising a relatively thin and readily flexible circular disc, means rotatably mounting said twist imparting members such that portions of the respective yarn engaging friction surfaces are disposed in opposing, face to face relationship and define a twisting zone therebetween, drive means for operatively rotating each of said twist imparting members about their respective axes, and means operatively positioned with respect to said twist imparting members for applying a force to effect biasing of said twist imparting members toward each other locally at said twisting zone, and such that a yarn may be continuously moved through said twisting zone while having twist imparted thereto by frictional contact between the yarn and the respective opposed friction surfaces.

22. The yarn false twisting apparatus as defined in claim 21 wherein said biasing means comprises disc impingement means mounted adjacent the face of said flexible disc opposite its yarn engaging friction surface and aligned with said twisting zone.

23. The yarn false twisting apparatus as defined in claim 22 wherein said flexible disc includes an elastomeric component.

24. The yarn false twisting apparatus as defined in any one of claims 21–23 wherein each of said pair of twist imparting members comprises a circular disc, with said discs being mounted for rotation about substantially parallel axes, and wherein said twisting zone is located at a point laterally spaced from the plane defined by the parallel axes of rotation.

25. A method of false twisting yarn which comprises the steps of operatively rotating a pair of twist imparting members, with each member including a yarn engaging friction surface, and at least one of said members comprising a relatively thin and readily flexible circular disc, and such that portions of the respective yarn engaging friction surfaces are disposed in opposing, face to face relationship and define a twisting zone therebetween, while applying a force at a location with respect to said twist imparting members to effect biasing of said pair of twist imparting members toward each other locally at said twisting zone, and while advancing a yarn through said twisting zone so that twist is imparted thereto by the frictional contact between the yarn and the respective opposed friction surfaces which results from the applied force.

26. The method as defined in claim 25 wherein each of said twist imparting members comprises a circular disc, and wherein the rotating step includes rotating said discs about generally parallel, spaced apart axes with the twisting zone being disposed at a point laterally spaced from the plane defined by such axes.

27. The method as defined in claim 26 wherein said rotating step further includes rotating said discs in opposite rotational directions, and said advancing step includes advancing the yarn along a path extending generally perpendicular to the plane defined by said axes of rotation and between the axes of rotation.

28. The method as defined in claim 26 wherein said rotating step further includes rotating said discs in a common rotational direction, and said advancing step includes advancing the yarn along a path extending generally parallel to a line extending perpendicularly between the axes of rotation.

* * * * *

UNITED STATES PATENT AND TRADEMARK OFFICE

CERTIFICATE OF CORRECTION

PATENT NO. : 4,339,915

DATED : July 20, 1982

INVENTOR(S) : Peter Dammann; Heinz Schippers; Karl Bauer

It is certified that error appears in the above-identified patent and that said Letters Patent are hereby corrected as shown below:

Column 2, line 33, change "form" to -- forms --.

Column 4, line 9, change "configuration" to -- configurations --.

Column 5, line 34, change "metalic" to -- metallic --.

Add the following Claims 29-33:

29. A yarn false twisting apparatus comprising a pair of twist imparting circular discs, with each disc including a yarn engaging friction surface, and at least one of said discs being flexible, means rotatably mounting said discs for rotation about respective spaced apart axes such that portions of the respective yarn engaging friction surfaces are disposed in opposing, face to face relationship and define a twisting zone therebetween, with said twisting zone being located at a point laterally spaced from a line extending between the centers of the discs when viewed in plan, drive means for operatively rotating each of said discs about their respective axes, and disc impingement means operatively positioned adjacent the face of said flexible disc opposite its yarn engaging friction surface for applying a localized force to said face which force is aligned with said twisting zone to effect biasing of said flexible disc toward the other disc locally at said twisting zone, and such that a yarn may be continuously moved through said twisting zone while having twist imparted thereto by frictional contact between the yarn and the respective opposed friction surfaces.

UNITED STATES PATENT AND TRADEMARK OFFICE

CERTIFICATE OF CORRECTION

PATENT NO. : 4,339,915

DATED : July 20, 1982

INVENTOR(S) : Peter Dammann; Heinz Schippers; Karl Bauer

It is certified that error appears in the above-identified patent and that said Letters Patent are hereby corrected as shown below:

30. A yarn false twisting apparatus as defined in Claim 29 wherein said drive means acts to rotate said discs in opposite rotational directions, and further comprising yarn guide means for guiding a running yarn through said twisting zone and in a direction perpendicular to a line extending between the centers of the discs when viewed in plan.

31. A yarn false twisting apparatus as defined in Claim 29 wherein said drive means acts to rotate said discs in a common rotational direction, and further comprising yarn guide means for guiding a running yarn through said twisting zone and in a direction generally parallel to a line extending between the centers of the discs when viewed in plan.

32. A yarn false twisting apparatus as defined in either of Claims 30 or 31 wherein said biasing force is limited to an area in direct alignment with the yarn.

33. A yarn false twisting apparatus comprising a pair of twist imparting members, with each member including a yarn engaging friction surface, and at least one of said members comprising a flexible circular disc, means rotatably mounting said twist imparting members such that portions of the respective yarn engaging friction surfaces are disposed in opposing, face to face relationship and define a twisting zone therebetween, yarn guide means for guiding a running yarn through said twisting zone,

UNITED STATES PATENT AND TRADEMARK OFFICE

CERTIFICATE OF CORRECTION

PATENT NO. : 4,339,915

DATED : July 20, 1982

INVENTOR(S) : Peter Dammann; Heinz Schippers; Karl Bauer

It is certified that error appears in the above-identified patent and that said Letters Patent are hereby corrected as shown below:

drive means for operatively rotating each of said twist imparting members about their respective axes, and disc impingement means operatively positioned adjacent the face of said flexible disc opposite its yarn engaging friction surface for applying a localized force to said face which is aligned with said twisting zone and limited to an area in direct alignment with the yarn to effect biasing of said flexible disc toward the other member locally at said twisting zone, and such that a yarn may be continuously moved through said twisting zone while having twist imparted thereto by frictional contact between the yarn and the respective opposed friction surfaces.

On the title page, "28 Claims" should read

-- 33 Claims --.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*